US009556646B2

(12) United States Patent
Matre

(10) Patent No.: US 9,556,646 B2
(45) Date of Patent: Jan. 31, 2017

(54) LATCH ACTUATING DEVICE

(71) Applicant: HMI USA, INC., Mequon, WI (US)

(72) Inventor: Daniel A. Matre, Brookfield, WI (US)

(73) Assignee: HMI USA, INC., Mequon, WI (US)

( * ) Notice: Subject to any disclaimer, the term of this patent is extended or adjusted under 35 U.S.C. 154(b) by 0 days.

(21) Appl. No.: 14/818,726

(22) Filed: Aug. 5, 2015

(65) Prior Publication Data

US 2016/0040453 A1 Feb. 11, 2016

Related U.S. Application Data

(60) Provisional application No. 62/034,273, filed on Aug. 7, 2014.

(51) Int. Cl.

| | |
|---|---|
| ***E05B 13/10*** | (2006.01) |
| ***E05B 15/00*** | (2006.01) |
| ***E05B 1/00*** | (2006.01) |

(52) U.S. Cl.

CPC ..... *E05B 15/0033* (2013.01); *E05B 1/00* (2013.01); *Y10T 70/5429* (2015.04); *Y10T 70/5442* (2015.04); *Y10T 70/5801* (2015.04)

(58) Field of Classification Search

CPC .... E05B 15/0033; E05B 1/00; Y10T 70/5429; Y10T 70/5442; Y10T 70/5469; Y10T 70/5473; Y10T 70/5792; Y10T 70/5796; Y10T 70/5801; Y10T 70/5819; Y10T 70/5823; Y10T 70/5827

USPC ..... 70/215–217, 221–224, 467, 473, 475, 70/478, 484, 485

See application file for complete search history.

(56) References Cited

U.S. PATENT DOCUMENTS 1,010,727 A * 12/1911 Corbin et al. ..... E05B 55/005 70/217
1,668,553 A * 5/1928 Douglas ..... E05B 57/00 192/69.7
1,698,201 A * 1/1929 Pietrie ..... E05B 67/24 70/168
1,755,434 A * 4/1930 Ellingson ..... E05B 55/005 292/DIG. 26
1,810,909 A * 6/1931 Ellingson ..... E05B 55/005 292/DIG. 27
1,845,963 A * 2/1932 Ellingson ..... E05B 13/108 292/DIG. 27
1,899,418 A * 2/1933 Jacobi ..... E05B 13/108 70/217

(Continued)

OTHER PUBLICATIONS

BAUER PRODUCTS web-site; https://www.bauerproducts.com/truckaccessoryhandles.php; 2015; US.

*Primary Examiner* — Lloyd Gall
(74) *Attorney, Agent, or Firm* — Boyle Fredrickson, S.C.

(57) ABSTRACT

The present invention is directed to a latch actuating device that includes a handle and a base. The handle has a cavity that houses a lockset, a drive cam, and a driven cam. The drive cam has a protrusion that is removably received within a locking receptacle in the base so as to permit and restrict rotation of the handle with respect to the base. The drive cam causes the driven cam to translate along a rotational axis of the drive cam when the drive cam is rotated by the lockset, thus effectuating the insertion and retraction of the protrusion with respect to the locking receptacle.

19 Claims, 10 Drawing Sheets

(56) References Cited

U.S. PATENT DOCUMENTS 1,986,676 A * 1/1935 Hurd ..... E05B 9/084 70/224
2,059,696 A * 11/1936 Jacobi ..... E05B 9/086 70/216
2,529,230 A * 11/1950 Smith ..... E05B 55/005 292/169.14
2,602,318 A * 7/1952 Belausteguigoitia . E05B 55/005 292/359
2,634,598 A * 4/1953 Kaiser ..... E05B 55/005 70/216
2,657,567 A * 11/1953 Young ..... E05B 55/005 70/216
3,922,896 A * 12/1975 Kagoura ..... E05B 55/005 70/149
4,036,039 A * 7/1977 Nakanishi ..... E05B 13/108 292/111
4,270,780 A * 6/1981 Bernard ..... E05B 63/0013 292/202
4,784,418 A * 11/1988 Pearson ..... E05B 3/065 24/681
5,317,889 A * 6/1994 Solovieff ..... E05B 9/086 70/224
5,388,434 A * 2/1995 Kalis ..... B60R 11/02 248/553
5,634,357 A * 6/1997 Nutter ..... E05B 13/106 70/203
5,882,053 A * 3/1999 Bekins ..... E05B 1/003 292/336.3
6,216,500 B1 * 4/2001 Kang ..... E05B 13/10 292/336.3
6,351,976 B1 * 3/2002 Chen ..... E05B 13/10 292/336.3
6,662,605 B2 * 12/2003 Molzer ..... E05B 13/106 292/336.3
7,966,854 B2 * 6/2011 Imedio Ocana .... E05B 47/0642 192/69.62
2004/0255627 A1 * 12/2004 Shimon ..... E05B 17/0058 70/379 R
2006/0169012 A1 * 8/2006 Liu ..... E05B 55/005 70/224
2009/0000342 A1 * 1/2009 Chen ..... E05B 55/005 70/224

* cited by examiner

LATCH ACTUATING DEVICE

CROSS-REFERENCE TO RELATED APPLICATIONS

This application claims priority to U.S. provisional patent application Ser. No 62/034,273, filed Aug. 7, 2014, the entire contents of which is incorporated herein by reference.

BACKGROUND OF THE INVENTION

The present invention relates generally to a latch actuating device that is used to actuate a latch for releasably sealing a door. Generally speaking, in one embodiment the latch actuating device includes a handle that is housed within a base. The handle is rotatable with respect to the base when in an unlocked position. There is a driven cam within the handle that translates along the body of the handle, i.e., along the axis of rotation of the handle, when the lockset is actuated, e.g., by a key. Thus, the rotation of the key rotates a tail of the lockset, thus causing the driven cam to translate along the housing and insert a protrusion into a locking receptacle of the base. There is a drive cam between the driven cam and the tail that engages the tail.

The Original Equipment Manufacturers (OEM) and after-market manufacturers in the light truck and utility truck industries use a variety of handle actuated latches that secure doors and panels to storage areas contained on vehicles. This latch actuating device focuses on a common latching device known as a T-handle. The handles include a variety of key actuated tumbler locksets that offer a range of sophistication. A growing trend is to include locksets that offer the ability to mechanically program numerous locksets on one vehicle with one key configuration. This type of lockset is commonly called a codeable lockset. This invention uniquely provides features and benefits for use with codeable or traditional locksets.

SUMMARY OF THE INVENTION

In one embodiment, a latch actuating device includes a handle and a lockset housed within the handle. The lockset has a rotatable tail that may be actuated by a key. There is a drive cam housed within the handle, with the drive cam being configured to receive the tail and be rotated by the tail. There is a driven cam housed within the handle. The driven earn has a protrusion that locks and unlocks the latch actuating device. A biasing element biases the driven cam toward the drive cam along the axis of rotation of the handle. There is a base that receives a portion of the handle such that the handle is rotatable with respect to the base. The base has a locking receptacle that receives the protrusion. As the driven cam translates along a rotational axis of the tail when the drive cam is rotated by the tail in a first direction, the protrusion is removably inserted into the locking receptacle to restrict rotation of the handle with respect to the base.

In another embodiment, the latch actuating device is a lockable actuator having a locked position and an unlocked position. The actuator includes a handle having a cavity and a lockset housed within, the cavity. The lockset has a rotatable tail. There is a rotatable drive cam housed within the cavity and coupled to the tail. A driven cam having a protrusion is coupled to the drive cam and housed within the cavity. There is a base that receives a portion of the handle. The base has a locking receptacle. The actuator is locked by rotating the tail in a first direction to move the driven earn along a rotational axis of the tail, thus inserting the protrusion into the locking receptacle of the base. This restricts rotational movement of the handle with respect to the base. The actuator is unlocked by rotating the tail in a second direction that is opposite the first direction, thus moving the driven cam along the rotational axis of the tail. This removes the protrusion from the locking receptacle.

In another embodiment of the invention, the latch actuating device includes a handle and a lockset housed within the handle. The lockset has a rotatable tail. There is a driven cam with a protrusion housed within the handle. A base receives a portion of the handle such that the handle is rotatable with respect to the base. The base has a locking receptacle for receiving the protrusion. When the tail is rotated, the driven cam translates along a rotational axis of the tail to removable insert the protrusion into the locking receptacle to restrict rotation of the handle with respect to the base. This locks the actuating device.

SUMMARY OF THE INVENTION

The latch actuating device provides transference of a rotational action at the exterior area of a storage compartment to the interior area, ultimately actuating a latching mechanism that holds an access door closed while providing security via a locking mode. A handle sub-assembly is captured by a base that is mounted to the door. The rotation of the handle transfers motion to the latching mechanism via a shaft that is integral to the handle.

The latch actuating device provides locking mode via 90 degree rotation of the lockset that actuates a drive cam with ramps to actuate a mating driven cam with corresponding ramps resulting in a linear translation of the driven cam that engages protrusions through the body of the rotating handle and into receptacles in the base.

One embodiment includes a pin that, depending upon the location in one of two holes, provides clockwise or counter clockwise biased rotation of the handle providing asymmetrical applications for the internal latching mechanism as required by left and right sides of compartment doors. In another embodiment, the latch actuating device is predetermined as a left turning or right turning actuator based upon the positioning of stops within the base.

DETAILED DESCRIPTION

Figure 1:
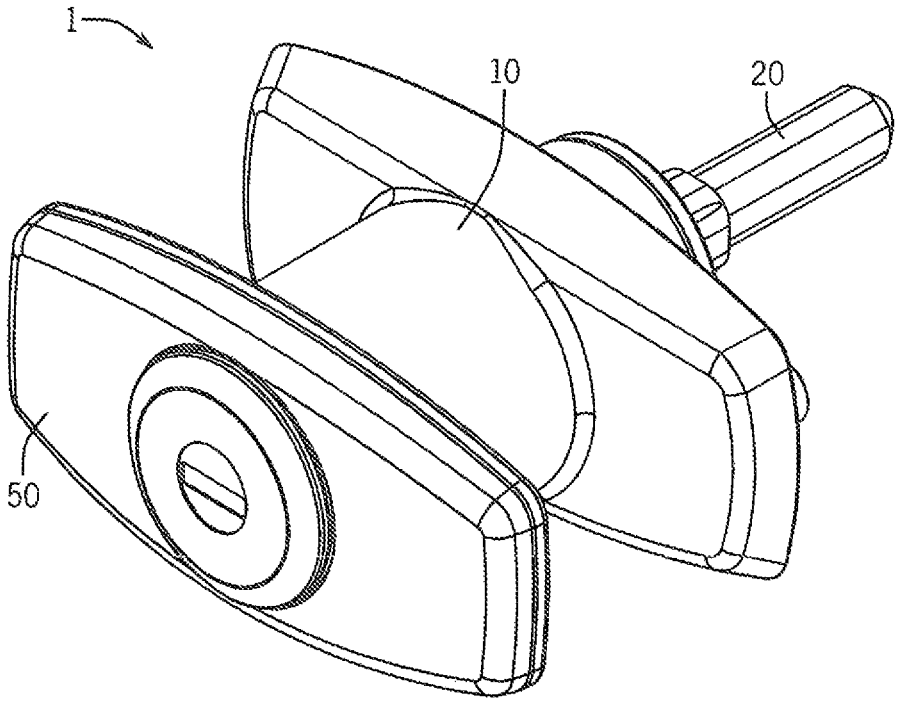
FIG. 1 is a perspective exterior view of one embodiment of the assembly.
Figure 2:
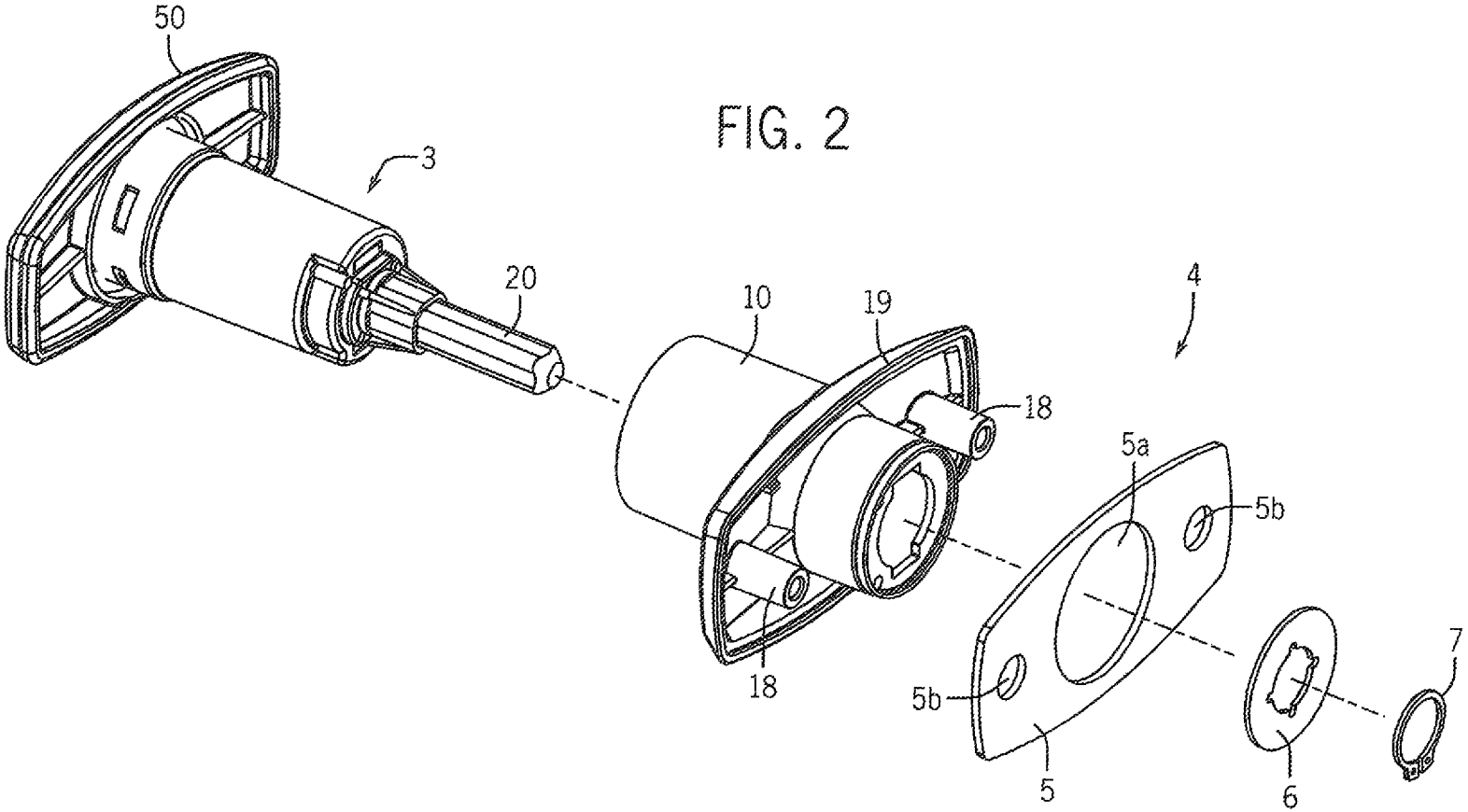
FIG. 2 is a perspective partially exploded view of the base assembly and the handle assembly of the embodiment of FIG. 1.

FIGS. 1-7 show one embodiment of the latch actuating device. FIG. 1 is a perspective view of the latch actuating device 1. The handle assembly 3 is received within the base assembly 4, together forming the latch actuating device 1. The general relationship between the handle assembly 3 and the base assembly 4 is shown in FIG. 2. The device further includes a washer 6 and a retainer 7 that cooperate to secure the handle assembly 3 to the base assembly 4. More specifically, the base assembly 4 accepts a gasket 5 that resides in a flange 19 and provides a seal with a variety of compartment access doors. The gasket 5 has two holes, base aperture 5*a* and boss aperture 5*b*, allowing portions of the base 10 to extend through a door (not shown) into the interior space of a compartment. A washer 6 and retainer 7 secure the assembly handle 3 to the base 10. Boss 18 offers points of attachment of the latch actuating device 1 to a compartment access door (now shown) via a variety of known fasteners.

Figure 3:
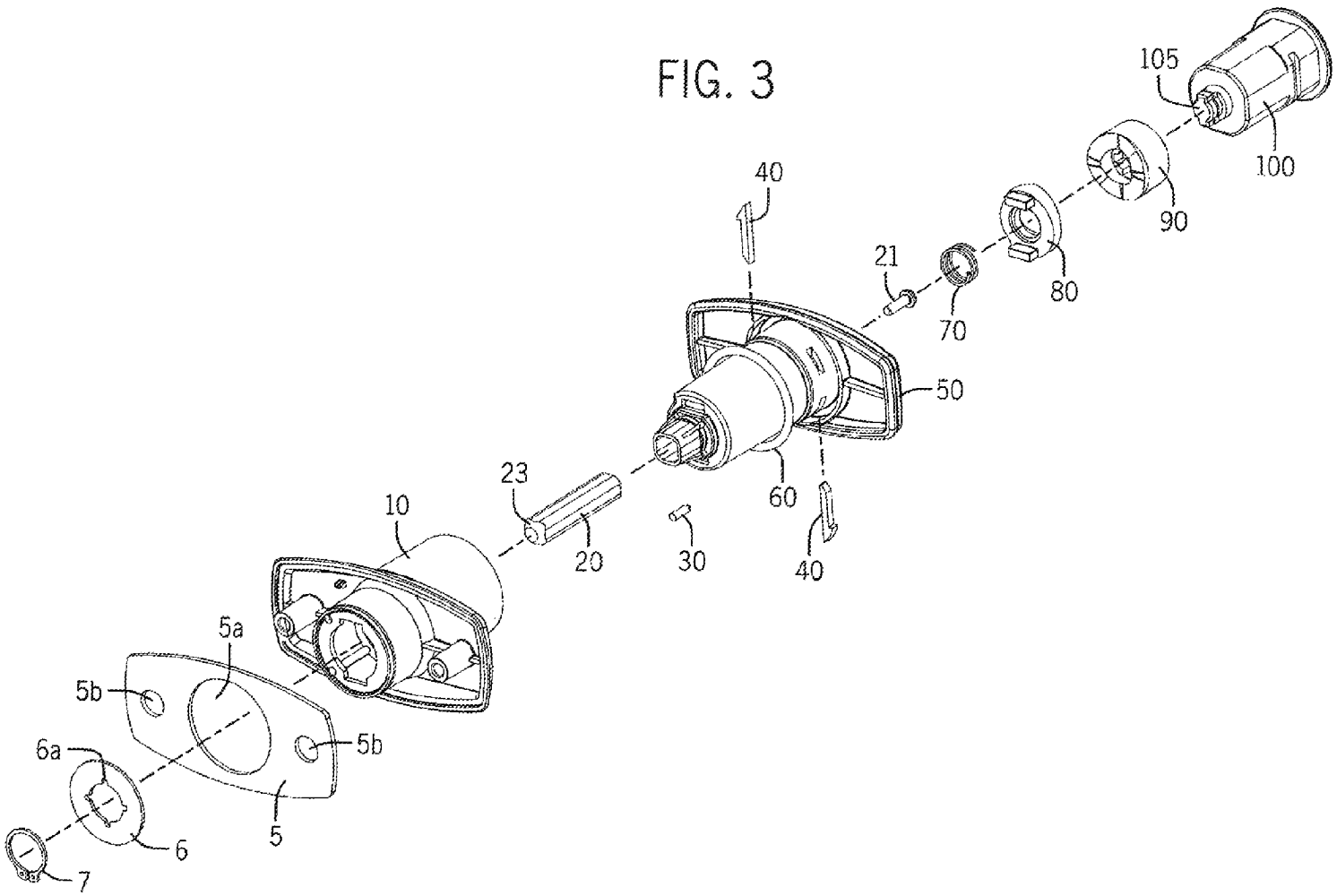
FIG. 3 is a perspective exploded view of the assembly of the embodiment of FIG. 1.

FIG. 3 is perspective exploded view of the latch actuating device 1. A lockset 100 is housed within the handle 50 and operably corrects to a drive cam 90 that interfaces with a driven calm 80. A biasing element, e.g., compression spring 70, keeps constant linear force (along the axis of rotation of the lockset 100) oar the driven cam 80 to provide retraction of the driven cam 80 and protrusions 82 (show in FIG. 6) when the tail 105 on the lockset 100 is in an unlocked position. A retainer 40 (or a plurality of retainers, not shown) captures the lockset 100 to the body of the handle 50 by passing through a channel 102 (shown in FIG. 6) and the handle slot 52. After assembly, the retainer 40 is secured by the support 1 (shown in FIG. 4). An o-ring 60 provides sealing of the base 10 with the handle 50 to deter foreign material from entering the latch actuating assembly 1. A drive shaft 20 is operably connected to the handle 50, e.g., by a threaded fastener 21. The drive shaft includes a bevel 23. A stop 30 which in this embodiment is a pin 30, is captured by a channel 56 (shown in FIG. 5) in the handle 50 limiting the rotation of the handle 50 about the longitudinal axis of the base 10.

Figure 4:
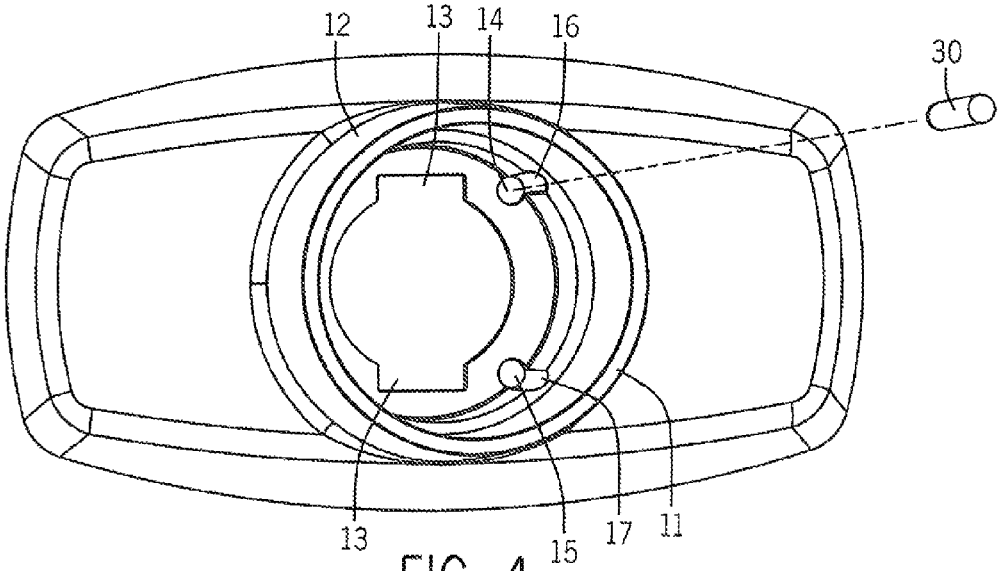
FIG. 4 is a perspective view of the base of the embodiment of FIG. 1.
Figure 5:
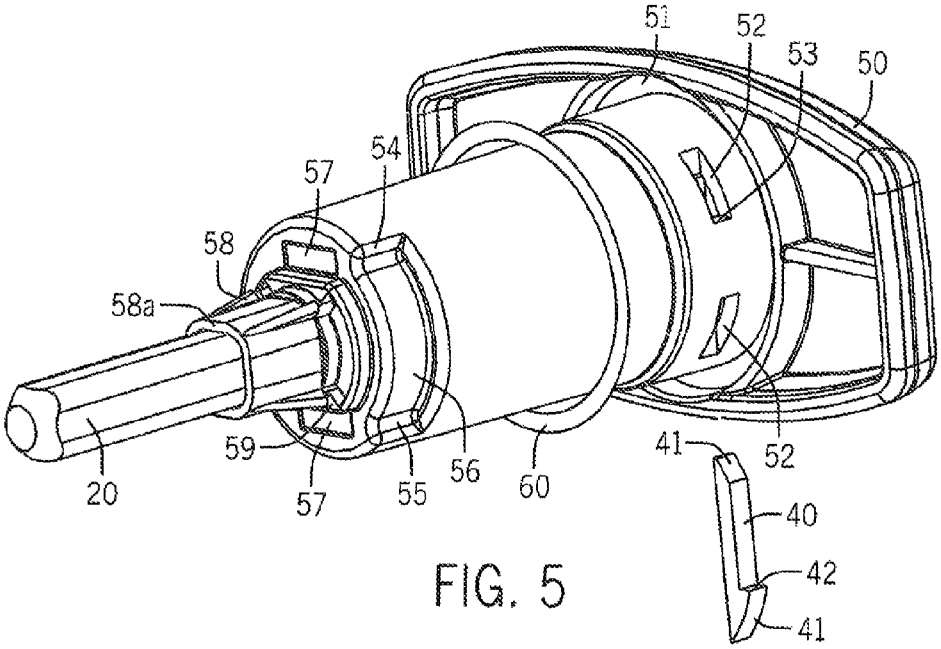
FIG. 5 is a perspective view of the handle assembly of the embodiment of FIG. 1.

FIG. 4 is a perspective view of the base 10. Rotation of the handle assembly 3 is restricted by a pin 30 that is pressed into hole 14 and supported, i.e., buttressed, by groove 16 or alternatively, a pin 30 that is pressed into hole 15 and supported, i.e., buttressed, by groove 17. Pin 30 has a bevel at one end and a semi-sphere at the other end for ease of insertion into base 10. Location of the pin 30 in hole 14 provides for a counter clockwise rotation of the handle assembly 3. Location of the pin 30 in hole 15 provides clockwise, rotation of the handle assembly 3. The handle 50 has stops 54 and 55 that engage the pin 30 and prevent rotation of the handle 50 (as shown in FIG. 5). As discussed above, the alternative locations of the pin 30 control the rotational direction, i.e., either clockwise or counter clockwise, of the handle 50 relative to the base 10. Thus, the lockset is customizable. Choosing the direction of rotation of the handle is important as the latch actuating device 1 may be installed on either the left side or right side of a compartment door, which typically have opposite latch configurations. Thus, the latch actuating device 1 may be used with either latch configuration.

FIG. 5 is a perspective view of the handle. The handle 50 has an annular channel 51 that receives the o-ring 60 that is compressed by the face 11 (FIG. 4) on the base 10. The retainer 40 includes a ledge 42 that is arrested by a stop 53 on the handle 50. The curvilinear surfaces 41 are concentric with the cylindrical exterior body of the handle 50 and are flush upon insertion to allow the face 11 of the base 10 to envelop and contain the retainer 40, deterring unauthorized disassembly of the latch actuating device 1. A channel 56 is defined by a counter clockwise stop 54 and clockwise stop 55 that receives the pin 30 attached to either hole 14 or hole 15 on the base 10. Openings 57 are mirrored to respectively receive the aligned protrusions 82 on the driven cam 80. The protrusions 82 on the driven cam 80, when engaging the openings 57 on the handle 50, prevent rotation of the driven cam 80 when the drive cam 90 rotates. Ribs 58 (the embodiment shown has four ribs 58) each have a notch 59 that supports the retainer 7. The retainer 7, in conjunction with the washer 6, keep the sub-assembly handle 3 attached to the base 10. The gasket 110 is compressible by the flange 103 and provides variable thickness to better facilitate the retainer 7. The washer 6 has a notch 6*a* that corresponds to the rib 58 allowing assembly. Boss 58*a* supports shaft 20.

Figures 6, 7:
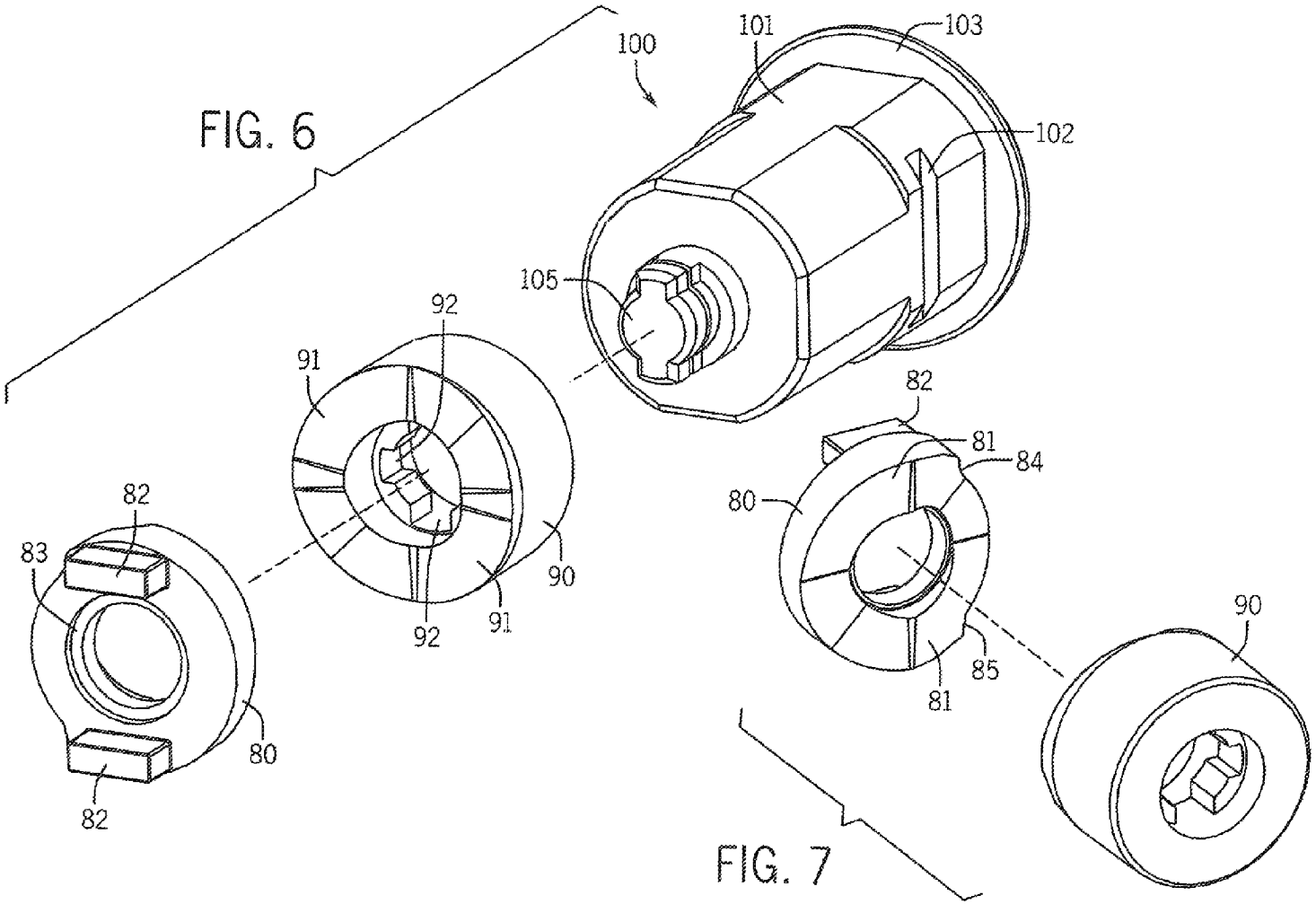
FIG. 6 is a perspective exploded view of the lockset, the drive cam, and the driven cam of the embodiment of FIG. 1.
FIG. 7 is a perspective a perspective exploded view of the drive cam and the driven cam of the embodiment of FIG. 1.

FIG. 6 is a perspective exploded vie % of the cams and the lockset, which are housed within a cavity, in the handle. In the embodiment shown, the cavity is generally cylindrical. FIG. 7 is another perspective view of the cams. The lockset 100 provides rotational input to the drive cam 90 via the tail 105 that is rotated indirectly by a key, not shown, by insertion of the key into the slot 106. The tail 105 engages the driven cam 90 via vertical receptacles 92, which are sized to receive the tail 105 (shown in FIG. 8). The tail 105 may non-circular cross section so as to provide an engagement member(s) that may be received by receptacles 92. For example, as shown in FIG. 6, the tail 105 has two diametrically opposed protrusions extending from the perimeter of the tail 105. The lockset 100 includes a facet 101 that provides orientation to the handle 50.

The rotational force of the tail 105 is transferred to the drive cam 90 via the slots 92. The tail 105 may be aligned with either set of opposed slots 92. The drive cam 90 includes one or more ramps 91 that correspond to one or more ramps 81 on the driven cam 80. The driven cam 80, and therefore the driven ramp 81, does not rotate because the protrusions 82 engage the openings 57 on the handle 50. Stops 54 and 55 also prevent rotation of the driven cam. Therefore, when the drive cam 90 is rotated, the rotational motion is transformed into linear motion along the longitudinal axis of the device as the drive cam 90 rotates with respect to the driven cam 80. As this rotation occurs, ramps 91 respectively travel along ramps 81, thus pushing the driven cam 80 along the rotational axis of the device and against the force of the biasing element 70 toward the receptacles 13 on the base 10. The protrusions 82 on the driven cam 80 extend through openings 57 to engage the locking receptacles 13 on the base 10 to establish a locked position of the latch actuating device 1. In other words, engagement of the protrusions 82 with locking receptacles 13 prevents the handle 3 from rotating. A compression spring 70 biases the driven cam 80 away from the base 10 and toward the handle 50 so that when the tail 105 and drive cam 90 are rotated in the opposite direction, the compression spring 70 pushes the driven cam 80 along the axis of rotation and the protrusions 82 retract from the locking receptacles 13 on the base 10, thus providing an unlocked position of the actuating device 1. The compression spring 70 is held in place by a counter bore 83 on the driven cam 80. Linear motion of the driven cam 80 is guided by counter clockwise stop 84 and clockwise stop 85, which align with the corresponding counter clockwise stop 54 and clockwise stop 55 that are formed in the handle 50.

Figure 8:
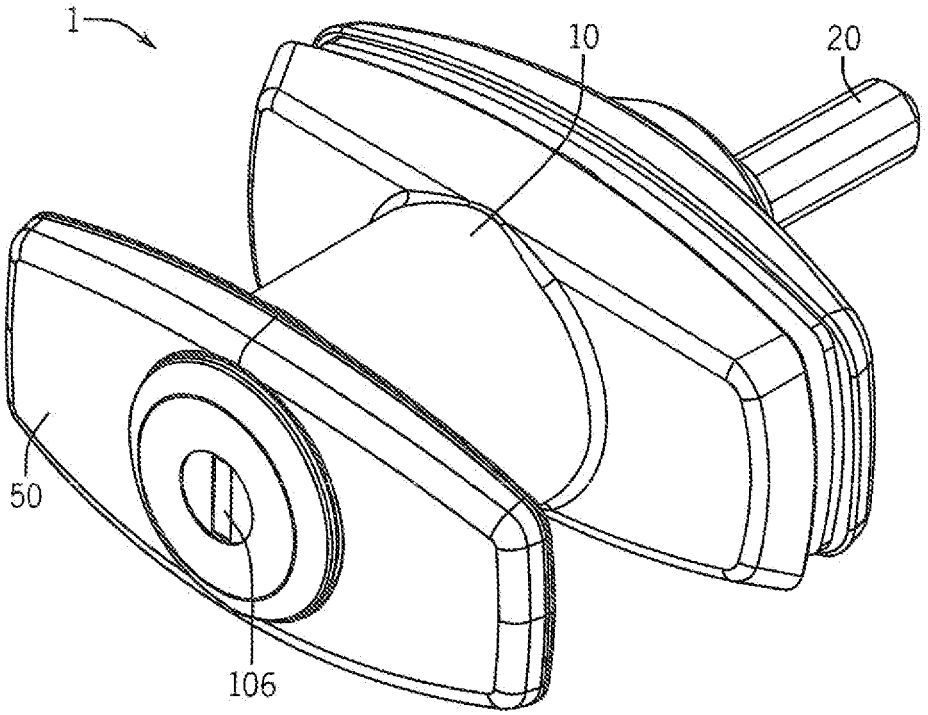
FIG. 8 is a perspective exterior view of another embodiment of the assembly.
Figure 9:
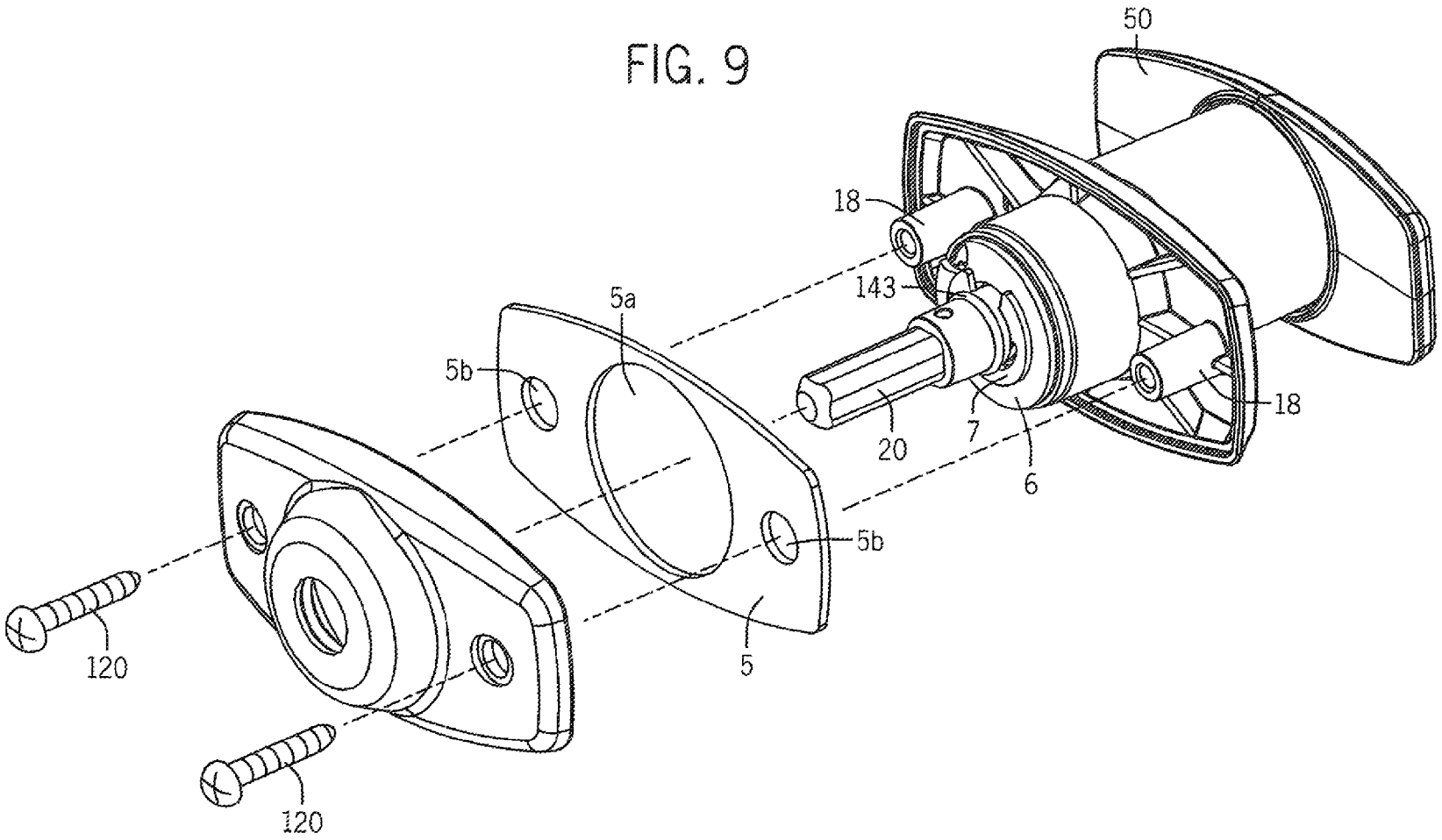
FIG. 9 is a perspective partially exploded view of the base assembly and the handle assembly of the embodiment of FIG. 8.

FIGS. 8-14 show another embodiment of the latch actuating device 1. FIGS. 8 and 9 show perspective views of the latch actuating device 1. FIG. 9 shows an exploded view of the handle sub-assembly 3 with base sub-assembly 4. The key slot 106 receives a standard or code-able key (not shown) that, when in an unlocked position, enables rotation of the drive shaft 20 about the longitudinal axis of the latch actuating device 1. Handle assembly 3 is attached to a panel e.g., a component of a vehicle (not shown), with which the latch actuating device may be used, via the base assembly 4 providing a clamping force with threaded fasteners 120 engaging the handle assembly 3.

Figure 10:
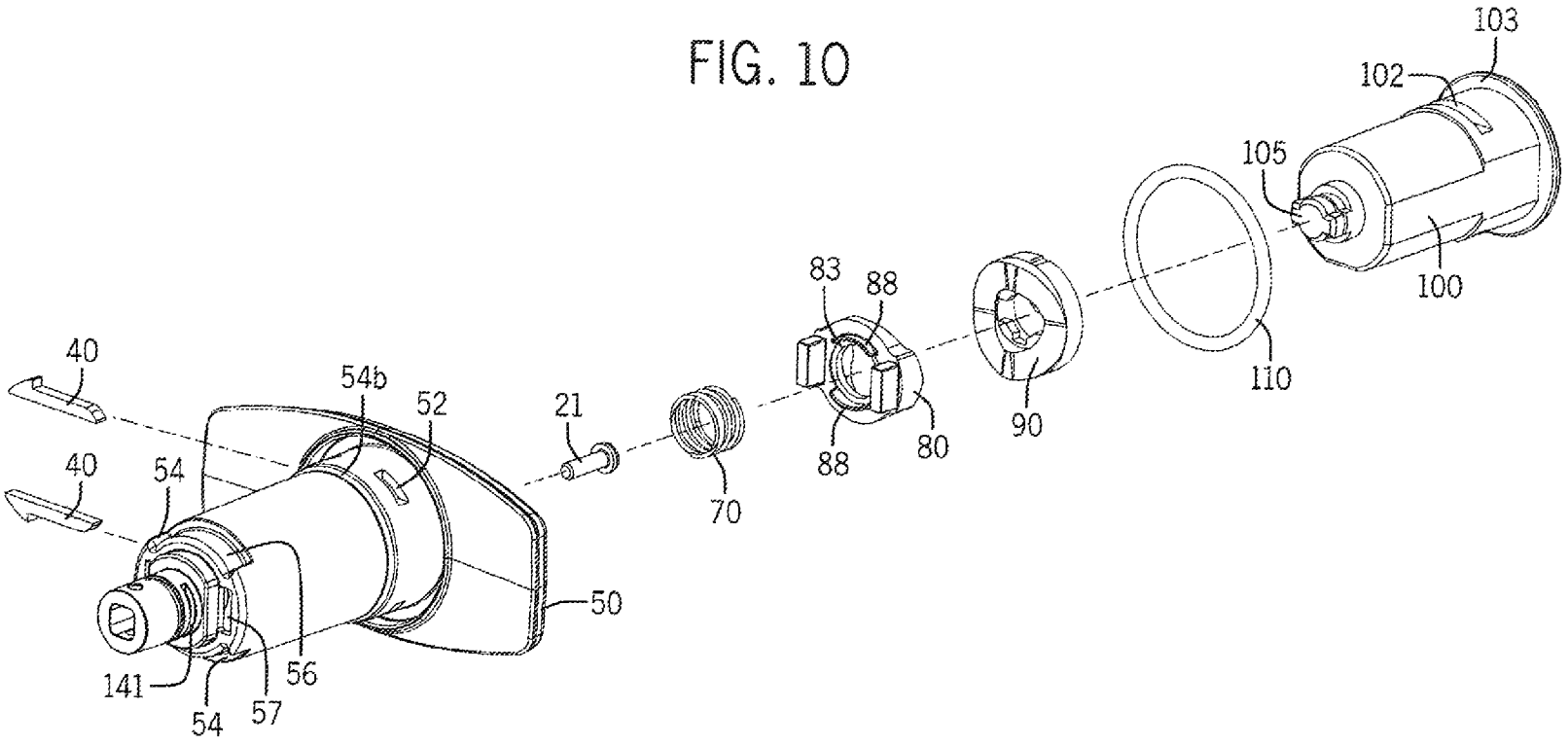
FIG. 10 is a perspective exploded view of the assembly of the embodiment of FIG. 8.

FIG. 10 is a perspective exploded view of the handle 3. Lockset 100 includes a channel 102 that receives a retainer 40 to retain the lockset 100 to the handle 50 via the slot 52 and when the retainer 40 is inserted into the slot 52. The assembly may include a one or more channels 102, corresponding slots 52 and retainers 40. For example, the embodiment shown includes two channels 102, two slots 52, and two retainers 40. The retainer 40 engages the channel 102 with ledge 42 contacting stop 53 properly positioning retainer 40. Compression gasket 110 provides a seal between the flange 103 and the handle 50 and provides longitudinal adjustment of the lockset 100 and channel 102 to align with slot 52 to receive retainer 40. Surface 41 is concentric with secondary cylindrical offset 54*b* to be flush with secondary cylindrical offset 54*b* after assembly.

Figure 11:
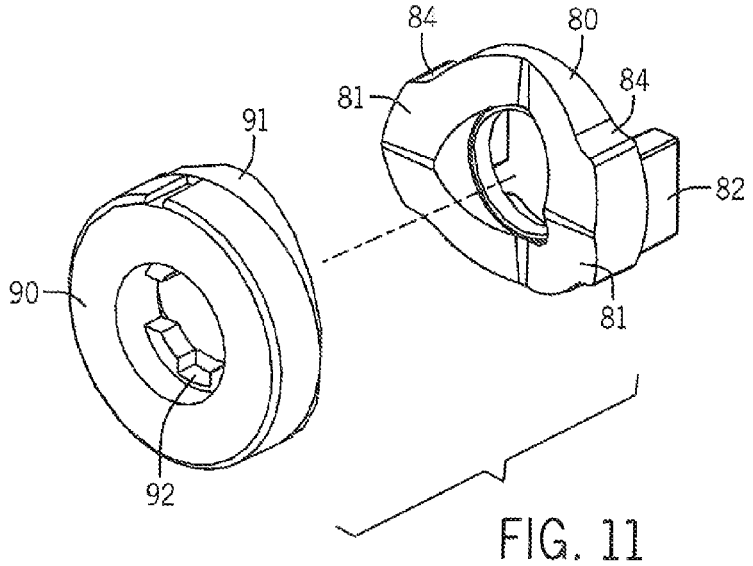
FIG. 11 is a perspective exploded view of the drive cam and the driven cam of the embodiment of FIG. 8.
Figure 13:
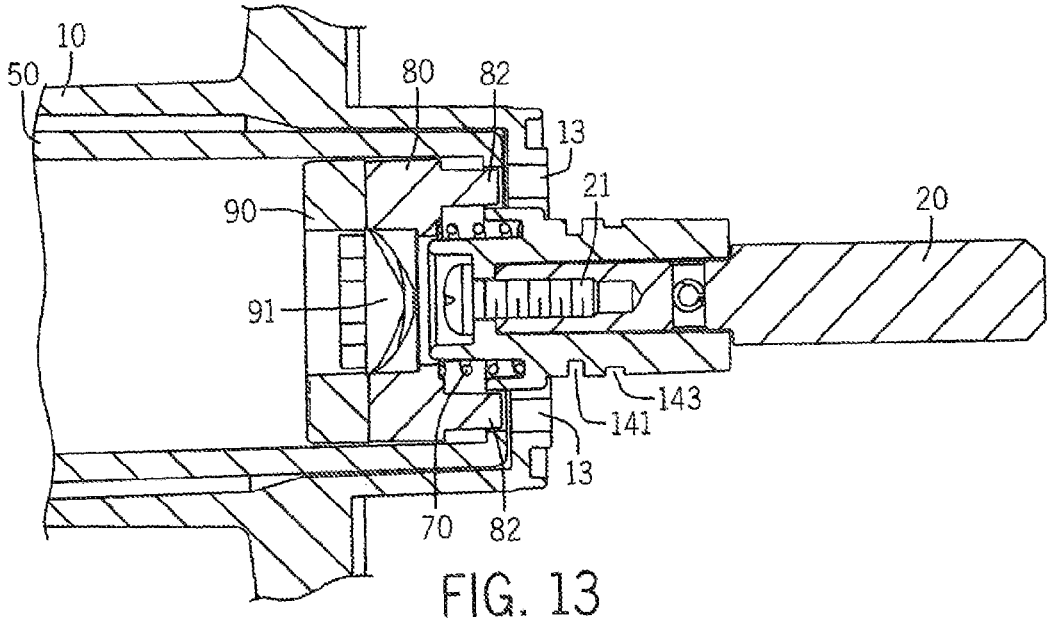
FIG. 13 is a cross-section of the handle assembly of FIG. 8 shown in the unlocked position.
Figure 14:
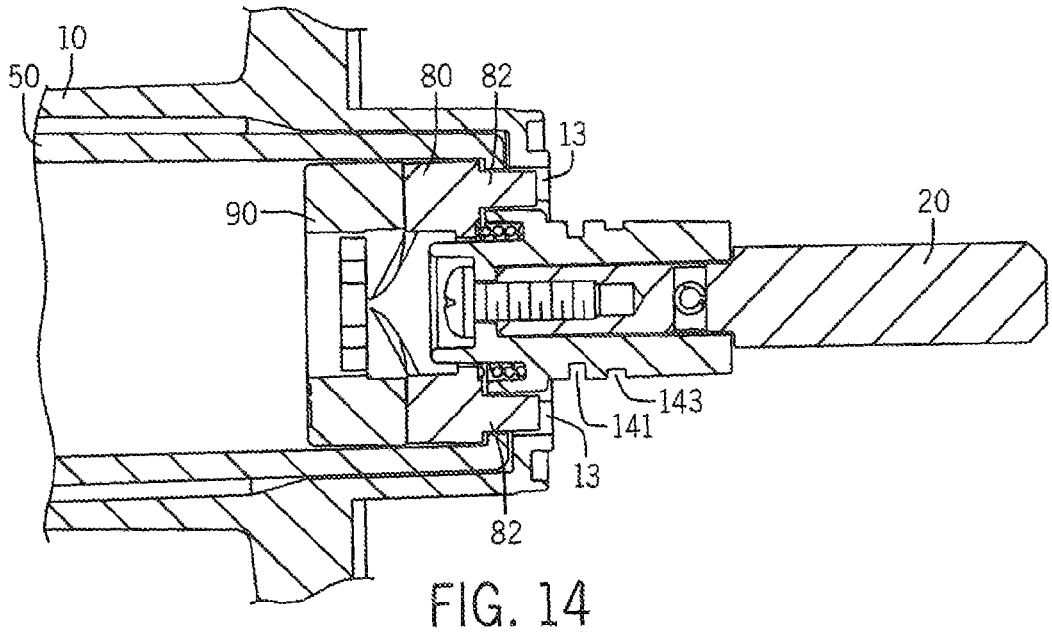
FIG. 14 is a cross-section of the handle assembly of FIG. 8 shown in the locked position.

Tail 105 is rotated about the longitudinal axis of the assembly 1 via a key (not shown) inserted into key slot 106 and rotates drive cam 90 by engaging vertical one or more receptacles 92. As shown, one set of diametrically opposed receptacles 92 receive the tail 105. Receptacles 92 may be of different configurations to match different configurations of tail 105. As shown in FIGS. 10 and 11, drive cam 90 includes one or more ramped surfaces 91 that act upon the driven cam 80 resulting in the linear translation of the driven cam 80 along the longitudinal axis (i.e., the axis of rotation of the tail 105 and the drive shaft 20) of the latch actuating device 1. Driven cam 80 is prevented from rotating via one or more stops 54 that engage corresponding stops 54 in the interior surface of the handle 3. Lack of rotation of driven cam 80 results in longitudinal linear motion of the protrusions 82 that travel through openings 57 to engage or disengage with locking receptacle 13 as shown in FIGS. 13 and 14, providing locked or unlocked modes of the handle 50 to the base 10. Compression spring 70 is contained by counter bore 83 and flange 88 and acts upon cam 80 to retract and disengage the protrusions 82 from locking receptacle 13 when the driven cam 80 is in an unlocked position. An O-ring 90 is received by an annular channel 51 providing a seal between the handle 50 and the base 10.

The handle 50 is secured to the base 10 via a retainer 7, which in this embodiment is an e-clip (see FIG. 9). The retainer 7 is received within a groove 141 on the handle 50, securing the handle 50 to the base 10. A washer 6 distributes the longitudinal loads of the retainer 7 about the base 80. The e-clip design enhances the serviceability of the latch actuating device 1. For example, the c-clip may be removed for disassembly of the latch actuating device, e.g., so that the lockset 100 may be replaced. The handle 50 includes another annular groove 143 that retains an o-ring (see FIG. 9) to seal the drive shaft support.

The handle assembly 3 includes lockset 100 that upon activation rotates drive cam 90. As drive cam 90 rotates, the ramps 91 of drive cam 90 slide along the ramps 81 of the driven cam 80, causing the driven cam 80 to linearly translate along the axis of rotation of drive cam 90. Compression spring 70 biases driven cam 80 toward drive cam 90 and therefor provides constant contact between the two cams. Compression gasket 110 provides a seal between the lockset 100 and the base 10 to deter moisture and debris from entering the exterior view assembly. Lockset 100 is retained, within the handle 50 by one or more retainers 40 in conjunction with channels 102 and slots 52.

Figure 12:
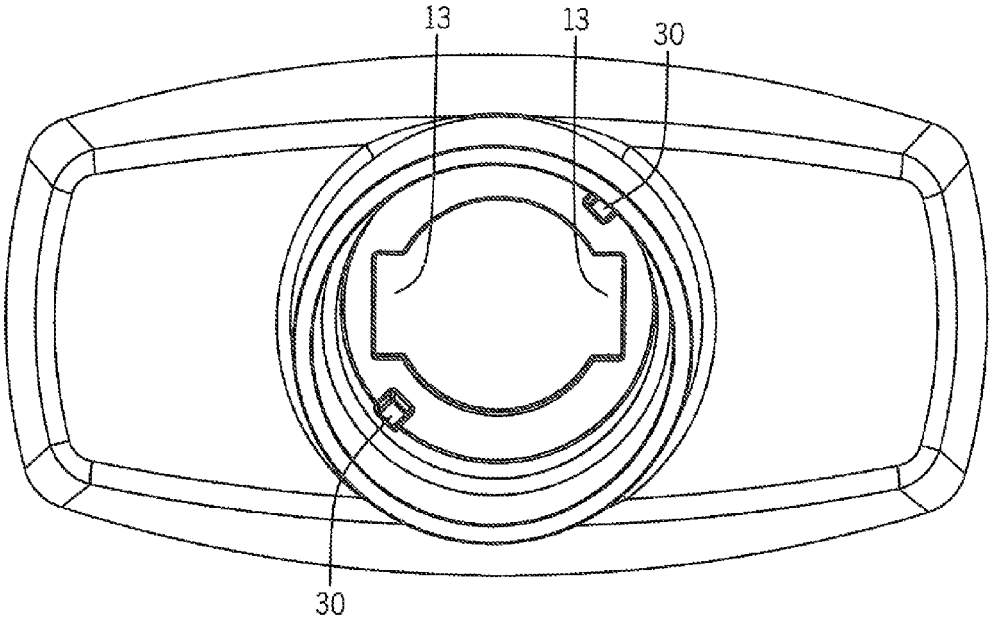
FIG. 12 is a perspective view of the base of the embodiment of FIG. 8.

FIG. 12 is a perspective view of base 10. Base 10 includes at least one stop 30 that interacts with a corresponding stop 54 on the handle 50 to limit rotation of handle 50. In this embodiment, the base 10 includes two diametrically opposed stops 30 and the handle includes two recessed sections 56 (or channels), with each recessed section 56 comprising a pair of stops 54. Thus, each stop 30 is received within a recessed section 56. As the handle 50 is rotated, the stop 30 travels along the recessed section 56 until contacting either end of the recessed section 56, which are stops 54. The interaction of the stop 30, the recessed section 56, and the stops 54 at either end of the recessed section, dictate the degree to which the handle 50 can rotate. The stops 30 may be positioned so that the latch actuation device will operate in a right-handed manner, i.e., as shown in FIG. 12, or in a left-handed matter, i.e., with the stops 30 oriented 90° from the position shown in FIG. 12.

FIG. 13 is a cross-section of the latch actuating device of FIG. 8 (lockset 100 not shown), showing the assembly in an unlocked position. As shown, the protrusions 82 of the driven cam 80 are retracted from the locking receptacles 13 of the base 10. In this position, the peaks of the ramps 91 on the drive cam 90 are substantially aligned with the valleys of the ramps 81 on the driven cam 80 so that the respective ramp-side surfaces of the cams are substantially flush.

FIG. 14 is a cross-section of the latch actuating device of FIG. 8 (lockset 100 not shown), showing the assembly in a locked position. As shown, the protrusions 82 of the driven cam 80 are positioned within the locking receptacles 13 of the base 10 so that the actuating device is locked. In this position, the peaks of the ramps 91 on the drive cam 90 are substantially aligned with the peaks of the ramps 81 on the driven camp 80 so as to create spacing between the drive cam 90 and the driven cam 80.

Thus, beginning at the unlocked position shown in FIG. 13, when the drive cam 90 is rotated, the peaks of the ramps 81 and 91 approach each other so as to translate the driven can 80 along the rotational axis of the drive cam 90 away from the drive cam 90 and against the force of the biasing element 70. This causes the protrusions 82 to be inserted into the locking receptacles 13 as shown in FIG. 14. When the drive cam 90 is rotated in the opposite direction, the peaks of the ramps 81 and 91 move toward the respective valleys, causing the driven cam 80 to retract toward the drive cam 90 under the force of the biasing element 70, thus returning the lock actuating device to the unlocked position.

Various alternatives and modifications are contemplated as being within the scope of the subject matter regarded as the invention.

I claim:

1. A latch actuating device comprising:

a handle comprising a body extending between a first end of the handle and a second end of the handle, the body of the handle having an outer surface and an inner surface;

a recessed portion extending inwardly from the outer surface of the body at a second end of the handle and extending inwardly from the inner surface of the body;

a lockset housed within the handle, the lockset having a rotatable tail;

a drive cam housed within the handle, the drive cam configured to receive and be rotated by the tail;

a driven cam housed within the handle, the driven cam having a protrusion;

a biasing element that biases the driven cam toward the drive cam; and a base that receives a portion of the handle such that the handle is rotatable with respect to the base, the base having a locking receptacle for receiving the protrusion;

wherein the driven cam translates along a rotational axis of the tail when the drive cam is rotated by the tail in a first direction so as to removably insert the protrusion into the locking receptacle to restrict rotation of the handle with respect to the base.

2. The latch actuating device of claim 1, wherein the drive cam has a pair of ramps and the driven cam has a corresponding pair of ramps that cooperate to effectuate the translation of the driven cam when the drive cam is rotated by the tail.

3. The latch actuating device of claim 1, wherein the recessed portion substantially restricts rotational movement of the driven cam.

4. The latch actuating device of claim 3, wherein the base includes a stop that engages the recessed portion at the outer surface to limit rotational movement of the handle with respect to the base.

5. The latch actuating device of claim 4, wherein the recessed portion is one of two recessed portions and the stop is one of two stops, the recessed portions and the stops being positioned so that a respective stop corresponds to a respective recessed portion; and wherein the recessed portions partially encircle the driven cam to substantially restrict rotational movement of the driven cam.

6. The latch actuating device of claim 1, further comprising:

a retainer;

a channel in the lockset for receiving the retainer; and a slot in the handle through which the retainer is inserted to be received by the channel so as to removably secure the lockset within the handle.

7. The latch actuating device of claim 1, wherein the lockset is code-able.

8. The latch actuating device of claim 1 further comprising:

an e-clip; and a groove in the handle that receives the e-clip so as to restrict translation of the handle with respect to the base along a rotational axis of the handle.

9. A lockable actuator having a locked position and an unlocked position, the actuator comprising:

a handle having a cavity within a body;

a recessed portion extending radially inwardly from an outer surface of the body, and extending radially inwardly from an inner surface of the body;

a lockset housed within the cavity, the lockset having a rotatable tail;

a rotatable drive cam coupled to the rotatable tail and housed within the cavity, wherein the drive cam includes a first ramp and a diametrically opposed second ramp, each ramp defining a pinnacle disposed between a first inclined surface and a second inclined surface;

a driven cam coupled to the drive cam and housed within the cavity, the driven cam having a protrusion, wherein the driven cam includes a first ramp and a diametrically opposed second ramp, each ramp defining a pinnacle disposed between a first inclined surface and a second inclined surface;

a base that receives a portion of the handle, the base having a stop and a locking receptacle;

wherein the recessed portion restricts rotational movement of the driven cam with respect to the handle;

wherein the recessed portion cooperates with the stop to limit rotational movement of the handle with respect to the base;

wherein the locked position is effectuated by rotating the tail in a first direction to move the driven cam along a rotational axis of the tail and insert the protrusion into the locking receptacle of the base, thereby restricting rotational movement of the handle with respect to the base; and wherein the unlocked position is effectuated by rotating the tall in a second direction that is opposite the first direction to move the driven cam along a rotational axis of the tail and remove the protrusion from the locking receptacle.

10. The lockable actuator of claim 9, wherein the protrusion is one of two diametrically opposed protrusions and the locking receptacle is one of two diametrically opposed locking receptacles, the protrusions and the locking receptacles being positioned so that a respective protrusion corresponds to a respective locking receptacle.

11. The lockable actuator of claim 10, wherein the pinnacle of each of the first and second ramps of the driven cam is substantially aligned with a respective protrusion, and wherein a slope of the first inclined surfaces is substantially equal to the slope of the second inclined surfaces, of the driven cam ramps.

12. The lockable actuator of claim 11, wherein the first and second ramps of the drive cam cooperate with the first and second ramps of the driven cam to cause the driven cam to translate along the rotational axis of the drive cam when the drive cam is rotated, and wherein a slope of the first inclined surfaces is substantially equal to the slope of the second inclined surfaces, of the drive cam ramps.

13. The lockable actuator of claim 12, further comprising:

a biasing element that biases the driven cam toward the drive cam; and flange on the driven cam that receives the biasing element.

14. The lockable actuator of claim 9, wherein the recessed portion is one of two diametrically opposed recessed portions and the stop is one of two diametrically opposed stops, the recessed portions and the stops being positioned so that a respective stop corresponds to a respective recessed portion.

15. A latch actuating device comprising:

a handle comprising a body extending between a first end of the handle and a second end of the handle, the body of the handle having an outer surface and an inner surface;

a recessed portion extending inwardly from the outer surface of the body at a second end of the handle, and extending inwardly from the inner surface of the body;

a lockset housed within the handle, the lockset having a rotatable tail;

a driven cam housed within the handle, the driven cam having a protrusion, a first ramp and a diametrically opposed second ramp, each ramp defining a pinnacle disposed between a first and second inclined surface, wherein a slope of the first inclined surfaces is substantially equal to a slope of the second inclined surfaces of the first and second ramp;

a base that receives a portion of the handle such that the handle is rotatable with respect to the base, the base having a locking receptacle for receiving the protrusion;

wherein the driven cam translates along a rotational axis of the tail when the tail is rotated so as to removably insert the protrusion into the locking receptacle to restrict rotation of the handle with respect to the base.

16. The latch actuating device of claim 15, further comprising a biasing element that biases the driven cam toward the tail.

17. The latch actuating device of claim 16, further including a drive cam between the driven cam and the tail, wherein the drive cam includes a first ramp and a diametrically opposed second ramp, each ramp defining a pinnacle disposed between a first and second inclined surface; and wherein a slope of the first inclined surfaces is substantially equal to a slope of the second inclined surfaces of the drive cam ramps.

18. The latch actuating device of claim 15, wherein:

the recessed portion is one of a pair of recessed portions in the handle, each recessed portion extending inwardly from the outer surface of the body at the second end of the handle, and extending inwardly from the inner surface of the body; and a pair of stops on the base;

wherein the recessed portions partially encircle the driven cam to substantially restrict rotational movement of the driven cam with respect to the handle; and wherein the recessed portions and the stops cooperate to limit rotational movement of the handle with respect to the base.

19. The latch actuating device of claim 15, further comprising:

an e-clip; and a groove in the handle that receives the e-clip so as to restrict translation of the handle with respect to the base along a rotational axis of the handle.

* * * * *